United States Patent [19]

Elo

[11] Patent Number: 4,811,941

[45] Date of Patent: Mar. 14, 1989

[54] SKATING DEVICE

[76] Inventor: Vesa Elo, Vaapelinkatu 5 A 10, SF-45130 Kouvola, Finland

[21] Appl. No.: 899,239

[22] Filed: Aug. 22, 1986

[30] Foreign Application Priority Data

Aug. 22, 1985 [FI] Finland ..... 853239

[51] Int. Cl.[4] ..... A63B 1/00; A63B 69/18

[52] U.S. Cl. ..... 272/70; 272/97; 272/117; 434/253

[58] Field of Search ..... 272/69, 96, 70, 97, 272/146, 118, 117, 142, 93; 128/25 R, 25 B; 434/253, 255

[56] References Cited

U.S. PATENT DOCUMENTS

| | | | |
|---|---|---|---|
| 1,297,800 | 3/1919 | Cranford | 272/70 |
| 3,591,172 | 7/1971 | Hude | 272/97 |
| 3,703,294 | 11/1972 | Fitch | 272/142 |
| 3,912,260 | 10/1975 | Rice | 272/97 |
| 4,515,363 | 5/1985 | Schleffendorf | 272/146 |
| 4,544,153 | 10/1985 | Babcock | 272/97 |
| 4,577,861 | 3/1986 | Bangerter et al. | 272/96 |

*Primary Examiner*—Richard J. Apley
*Assistant Examiner*—J. R. Crow
*Attorney, Agent, or Firm*—Kane, Dalsimer, Sullivan, Kurucz, Levy, Eisele and Richard

[57] ABSTRACT

This disclosure shows a skating device designed to enable the user to perform the physical movements required when ice skating in artificial conditions, such as, for example, when there is no readily accessible ice rink or frozen lake. As such, the skating device can be used indoors at any time of the year. The device itself consists of a frame with a step for each foot on an approximately horizontal, pivotable guide. Each step is slidingly movable along its pivotable guide. Biasing force means, arising from the use of suitable weights, oppose the skating movements of the user and restore the parts of the skating device to their initial rest positions following these movements. The frame includes a horizontal pole, whose position is adjustable, for gripping by the user's hands.

7 Claims, 1 Drawing Sheet

SKATING DEVICE

BACKGROUND OF THE INVENTION

1. Field of the Invention

This invention provides a stationary device, consisting of a frame with certain movable parts, designed for use in performing the physical movements required for ice skating under artificial conditions.

2. Description of the Prior Art

A device, such as that provided by the present invention, is essential because it allows a skater to practice even when he has no access to ice. Further, the skater can, with the present invention, practice skating movements indoors at any time of the year.

Until now, no device of this kind has been available on the market. In particular, there has been no stationary device, like that provided by the present invention, enabling one to perform natural skating movements in a very exact way under artificial conditions.

SUMMARY OF THE INVENTION

The present invention is designed to provide a simple device, occupying a small space, which will enable the user to perform the physical movements required during ice skating in a manner closely resembling that in which such movements are actually performed while skating.

Accordingly, the present invention provides a skating device for exercising natural skating movements comprising:

a frame having a horizontal section and vertical sections, said horizontal section serving as a base for said skating device, and said vertical sections providing a left and a right support to be gripped by the user of said skating device;

a left and a right elongated guide, each said guide having one end attached to the center of an edge of said horizontal section, and each said guide being pivotable about said attached end in a horizontal plane;

a left and a right step attached to said left and right guide respectively, each said step capable of gliding along the guide on which it is attached;

a first biasing force means for each said step, said first biasing force means acting upon said step in a direction toward said attached end of said guide;

a second biasing force means for each said guide, said second biasing force means tending to rotate said guides in opposite directions apart from one another, whereby the user of said skating device, having his left and right feet on said left and right steps respectively and gripping said left and right supports, can exercise natural skating movements by pushing outward and backward alternately with his left and right feet against the resistance provided by said first and second biasing force means.

BRIEF DESCRIPTION OF THE DRAWINGS

In order to describe the present invention in greater detail, reference will be made in the following description of the preferred embodiment to the figures of which.

DESCRIPTION OF THE PREFERRED EMBODIMENT

Figures 1, 2:
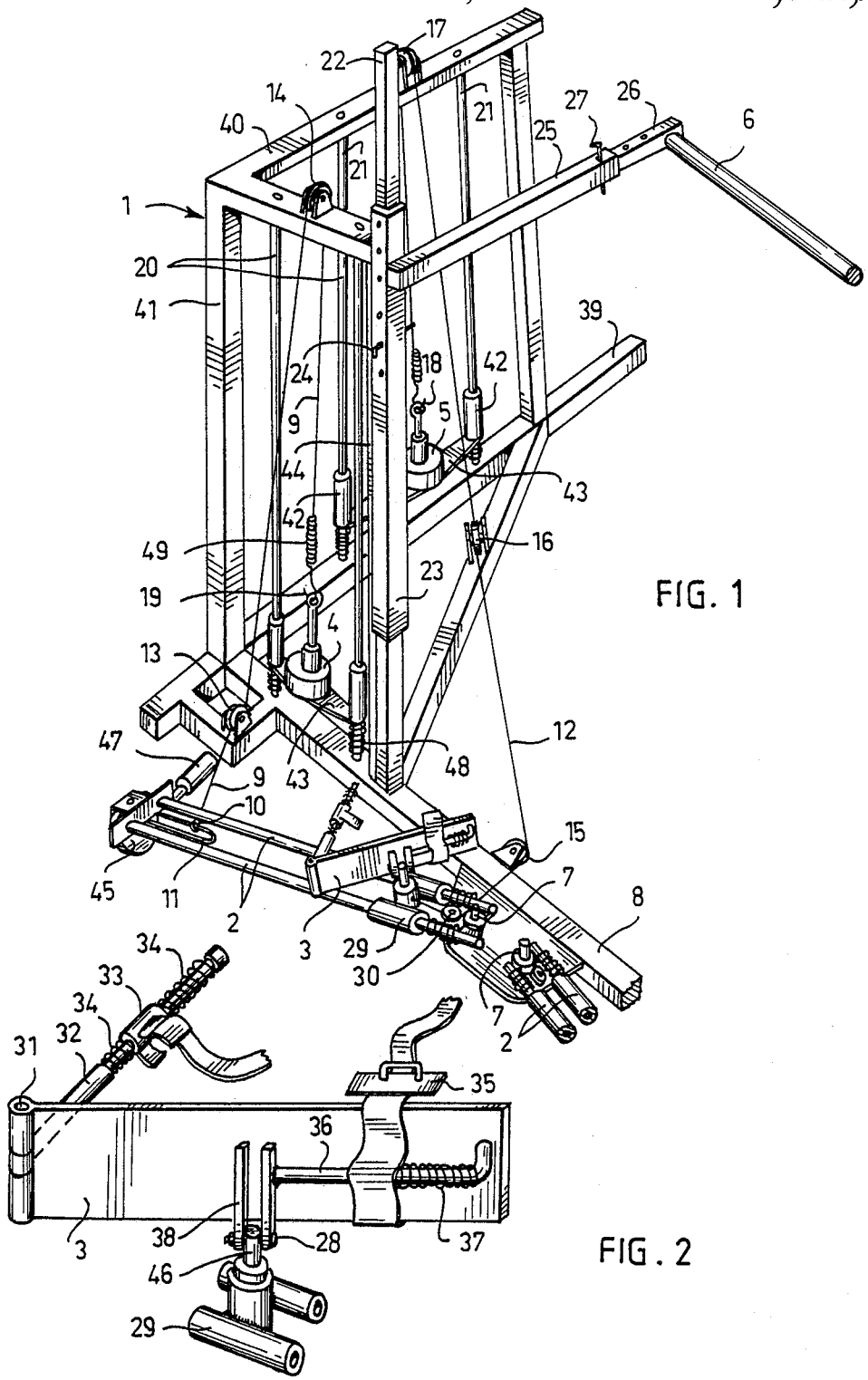
FIG. 1 shows a view of the left side of the skating device of the present invention.
FIG. 2 shows, in a larger scale than that employed in FIG. 1, one of the steps of the skating device.

With reference now to the figures, FIG. 1 shows a view of the left side of the skating device of the present invention. It should be understood that the right side of the skating device is a mirror image of the left side actually shown. As can be seen, the skating device comprises a frame 1 which, according to the embodiment shown, includes square tubes 8, 39, 40, 41, and 44. Square tubes 8 and 39 are intended to be placed against the floor or another similar base. The figure, as already noted, represents the left side of the skating device as seen by the person using it when he fastens his foot to step 3 and grabs pole 6 with his hands.

A pivotable guide 2 has been fastened at one end to square tube 8 of the frame 1 with bearing 7 so that it can pivot in an approximately horizontal plane. The other, or outer end of the pivotable guide 2 is provided with a wheel 45 which rolls along the floor, or similar base, when the pivotable guide 2 pivots around bearing 7. A step 3 is fastened by means of pivot 46 to glide 29 which can move back and forth along the pivotable guide 2. As shown in FIG. 2, the step 3 can pivot about a vertical axis by means of pivot 46. In addition, the step 3 can pivot about a horizontal axis by means of pin 28, which connects ears 38 on the underside of step 3 to the pivot 46, as shown in FIG. 2.

A wire cable 12 is fastened to glide 29 and, passing over, under or around pulleys 30, 15, 16, and 17, connects to weight 5. Weight 5 is supported on bar 43, having at each end a socket 42, each movable up and down along a vertical rod 21. When the glide 29 is moved along the pivotable guide 2 toward the end having wheel 45 by the user's foot on step 3, the wire cable 12 draws weight 5 upward along vertical rod 21. This same weight 5 acts to return glide 29 and step 3 back toward the end of the pivotable guide 2 with bearing 7, when the force imparted by the user's foot on step 3 is removed, by means of wire cable 12.

In addition, under the action of the user's foot upon step 3, the pivotable guide 2 turns in a horizontal plane about bearing 7. Such movement, when directed away from frame 1, is opposed by weight 4 which, by means of wire cable 9, passing over pulley 14 and under pulley 13, and attached to pivotable guide 2 at handle 11 by slideable link 10, tends to return pivotable guide 2 to a position adjacent to the frame 1. The return or rest position of pivotable guide 2 can be adjusted by means of limiter 47, whose length can be adjusted. As shown in FIG. 1, the limiter 47 is attached to pivotable guide 2, but it can also be attached to a part of frame 1, such as square tube 8. Weight 4 is guided by vertical rods 20, by means of bar 43 and sockets 42, in the same manner as is weight 5 previously described. A spring 49 may be combined with wire cables 9 and 12, attached to weights 4 and 5 respectively, to soften their movements. In addition, springs 48 may be positioned on vertical rods 20 and 21, beneath bars 43 and sockets 42 for weights 4 and 5, to soften the return action. The limiter 47 may also be provided with a spring, to soften the impact of pivotable guide 2 against frame 1, although this is not shown in FIG. 1.

Turning now to FIG. 2, drawn in a larger scale than that used in FIG. 1, one sees a detailed view of the step 3 of the present invention. As noted previously, step 3 is designed to pivot about both horizontal and vertical axes. This is achieved by means of pin 28 which attaches step 3 to pivot 46 by means of ears 38 on the underside of step 3. Pin 38 enables step 3 to pivot about a horizontal axis, while pivot 46 enables it to do so about a vertical axis. A rod 32 is connected to step 3 by a hinge 31 at the end of step 3 occupied, in use, by the heel of the user's foot. The rod 32 has a movable fastener 33 to be attached around the user's ankle. Springs 34, deployed on both sides of fastener 33 on rod 32 allow the fastener 33 a degree of back and forth movement. At the end of step 3 occupied, in use, by the toe of the user's foot, there is a fastener 35 for attaching the toe end of the user's foot to the step 3. Fastener 35 is attached to rod 36 on the underside of step 3. A spring 37 deployed at the toe end of rod 36 opposes the movement of fastener 35 in the forward direction.

Returning now to our discussion of FIG. 1, frame 1 comprises square tubes 8, 39, 40, 41, and 44, some horizontally disposed, others vertically disposed. As yet unmentioned, square tube 22, having a vertical orientation, serves to guide socket 23 situated about it. Socket 23 may be fixed at a desired vertical position on square tube 22 with cotter pin 24. Socket 23 includes a bracket 25 extending away from the user of the skating device. Within bracket 25 is a movable bar 26, which can be fixed at different positions by means of a second cotter pin 27. Pole 6 extends from bar 26 on the left side of the skating device, shown in FIG. 1, to the corresponding bar on the right side of the skating device, not shown. The person using the skating device holds on to pole 6, whose height and lateral position can be adjusted as described to suit the comfort of the individual user.

It is apparent that the present invention can be realized in many other ways than the embodiment described above. The frame itself may, for example, be constructed of other materials or another manner. In particular, wire cables 9 and 12 may be fastened to weights 4 and 5 respectively using hooks 19 and 18 respectively, so that weights 4 and 5 can be changed in magnitude by the addition or removal of incremental weights when the wire cables 9 and 12 are temporarily removed. Other such modifications would be obvious to one skilled in the art without departing from the scope of the invention as defined in the appended claims.

I claim:

1. A skating device for exercising natural skating movements comprising:

a frame having a horizontal section and vertical sections, said horizontal section serving as a base for said skating device, and said vertical sections providing a left and a right support to be gripped by the user of said skating device;

a left and a right elongated guide, each said guide having one end attached to the center of an edge of said horizontal section, and each said guide being pivotable about said attached end in a horizontal plane;

a left and a right step attached to said left and right guide respectively, each said step capable of gliding along the guide on which it is attached;

a first biasing force means for each said step, said first biasing force means acting upon said step in a direction toward said attached end of said guide;

a second biasing force means for each said guide, said second biasing force means tending to rotate said guides in opposite directions apart from one another, whereby the user of said skating device, having his left and right feet on said left and right steps respectively and gripping said left and right supports, can exercise natural skating movements by pushing outward and backward alternately with his left and right feet against the resistance provided by said first and second biasing force means.

2. A skating device as in claim 1 wherein said first biasing force means for each said step comprises a weight, a cable attached to said weight and directed to said step by means of pulleys attached to said frame, whereby said weight biases said step toward said attached end of said guide.

3. A skating device as in claims 2 wherein said weight is detachable from said cable, thereby permitting the substitution for said weight of other weights of different sizes.

4. A skating device as in claim 2 or 3 wherein the vertical movements of said weights are directed by a rod attached at its top and bottom end to a vertical section of said frame.

5. A skating device as in claim 1 wherein said left and right steps, each having a downward projection on its underside, swivel and tilt with respect to their corresponding guides by means of a mounting mechanism for each said step comprising:

a glide slideably attached to said guide;

a pivot, projecting upwardly from said glide and pivoting about a vertical axis; and a pin, horizontally engaging the downward projection on the underside of said step and said pivot, allowing said step to be pivotable about a horizontal axis.

6. A skating device as in claim 1 or 5 wherein said left and right steps each have ankle fasteners which are slideably attached to rods between pairs of biasing, centering springs, said rods being hingedly connected to said steps.

7. A skating device as in claims 1 or 5 wherein said left and right steps each have toe fasteners which are slideably attached to rods behind rearwardly biasing springs on the underside of said steps.

* * * * *